US012053037B1

(12) United States Patent
Dunn et al.

(10) Patent No.: US 12,053,037 B1
(45) Date of Patent: Aug. 6, 2024

(54) THERMAL MODIFICATION DEVICE

(71) Applicant: Thermapparel LLC, Rochester, NY (US)

(72) Inventors: Bradley James Dunn, Honeoye Falls, NY (US); Kurtis W. Unruh-Kracke, Rochester, NY (US)

(73) Assignee: Thermapparel LLC, Rochester, NY (US)

( * ) Notice: Subject to any disclaimer, the term of this patent is extended or adjusted under 35 U.S.C. 154(b) by 0 days.

(21) Appl. No.: 18/599,829

(22) Filed: Mar. 8, 2024

(51) Int. Cl.
*A41D 13/005* (2006.01)

(52) U.S. Cl.
CPC ..... *A41D 13/0053* (2013.01); *F25D 2303/08* (2013.01); *F25D 2303/082* (2013.01); *F25D 2303/0822* (2013.01); *F25D 2303/085* (2013.01); *F25D 2400/06* (2013.01)

(58) Field of Classification Search
CPC ..... F25D 2400/26; F25D 2303/08; F25D 2303/082; F25D 2303/0822; F25D 2303/084; F25D 2303/085; A41D 13/0053
See application file for complete search history.

(56) References Cited

U.S. PATENT DOCUMENTS

| | | | | |
|---|---|---|---|---|
| 3,463,161 | A * | 8/1969 | Stella | B65D 81/3895 126/400 |
| 4,856,294 | A * | 8/1989 | Scaringe | A41D 13/0058 165/902 |
| 6,645,598 | B2 * | 11/2003 | Alderman | B29C 66/83513 126/618 |
| 7,762,096 | B2 * | 7/2010 | Fuchs | A41D 13/0055 62/259.3 |
| 2006/0191063 | A1 * | 8/2006 | Elkins | A62B 17/005 2/458 |
| 2019/0142629 | A1 | 5/2019 | Shinozaki | |

* cited by examiner

*Primary Examiner* — Joseph F Trpisovsky
(74) *Attorney, Agent, or Firm* — Jong Patent Firm; Cheng Ning Jong; Tracy P. Jong

(57) ABSTRACT

A thermal modification device for modifying the skin temperature of a user, the thermal modification device including: a first elongated flexible container including a first substance disposed therein and a first wall and a second wall, wherein the first substance is a fluid having thermal properties of a first substance; and a second elongated flexible container including a second substance disposed therein and a first wall and a second wall, wherein the second substance is a fluid having thermal properties of a second substance, wherein a ratio of the mass of the first substance and the mass of the second substance is at least one of about 0.22 and about 0.31, the first elongated flexible container and the second elongated flexible container are disposed with the second wall of the first elongated flexible container disposed in contacting relationship with the first wall of the second elongated flexible container.

18 Claims, 14 Drawing Sheets

| Material | Heat Capacity(Liquid) | Heat of Fusion |
|---|---|---|
| Water | 4.182 J/g*ΔC | 333.55 J/g |
| 21C PCM | 2.3 J/g*ΔC | 190 J/g |

60

58

| Pack Area | Total Fill Density (oz/sq in) | Total Fill (oz) | PCM (oz) | PCM % | Water (oz) | Water % | Fit on 1.21" |
|---|---|---|---|---|---|---|---|
| 19.41 | 0.16 | 3.10 | 1.83 | 59% | 1.269864 | 41% | Y |
| 19.41 | 0.16 | 3.17 | 1.90 | 60% | 1.269864 | 40% | Y |
| 19.41 | 0.17 | 3.25 | 1.98 | 61% | 1.269864 | 39% | Y |
| 19.41 | 0.17 | 3.32 | 2.05 | 62% | 1.269864 | 38% | Y |
| 19.41 | 0.17 | 3.39 | 2.12 | 63% | 1.269864 | 38% | Y |
| 19.41 | 0.18 | 3.46 | 2.19 | 63% | 1.269864 | 37% | Y |
| 19.41 | 0.18 | 3.53 | 2.26 | 64% | 1.269864 | 36% | Y |
| 19.41 | 0.18 | 3.46 | 2.26 | 65% | 1.199316 | 35% | Y |
| 19.41 | 0.18 | 3.53 | 2.33 | 66% | 1.199316 | 34% | Y |
| 19.41 | 0.18 | 3.46 | 2.33 | 67% | 1.128768 | 33% | Y |
| 19.41 | 0.18 | 3.53 | 2.40 | 68% | 1.128768 | 32% | Y |
| 19.41 | 0.18 | 3.46 | 2.40 | 69% | 1.05822 | 31% | Y |
| 19.41 | 0.18 | 3.53 | 2.47 | 70% | 1.05822 | 30% | N |
| 19.41 | 0.18 | 3.46 | 2.47 | 71% | 0.987672 | 29% | N |
| 19.41 | 0.18 | 3.46 | 2.54 | 73% | 0.917124 | 27% | N |
| 19.41 | 0.18 | 3.53 | 2.61 | 74% | 0.917124 | 26% | N |
| 19.41 | 0.18 | 3.53 | 2.68 | 76% | 0.846576 | 24% | N |
| 19.41 | 0.18 | 3.53 | 2.75 | 78% | 0.776028 | 22% | N |
| 19.41 | 0.18 | 3.53 | 2.82 | 80% | 0.70548 | 20% | N |
| 19.41 | 0.18 | 3.46 | 3.46 | 100% | 0 | 0% | N |
| 19.41 | 0.18 | 3.53 | 3.53 | 100% | 0 | 0% | N |

*FIG. 18*

62

| Pack Area | Total Fill Density (oz/sq in) | Total Fill (oz) | PCM (oz) | PCM % | Water (oz) | Water % | Fit on 1.9" |
|---|---|---|---|---|---|---|---|
| 19.41 | 0.16 | 3.10 | 1.83 | 59% | 1.27 | 41% | Y |
| 19.41 | 0.16 | 3.17 | 1.90 | 60% | 1.27 | 40% | Y |
| 19.41 | 0.17 | 3.25 | 1.98 | 61% | 1.27 | 39% | Y |
| 19.41 | 0.17 | 3.32 | 2.05 | 62% | 1.27 | 38% | Y |
| 19.41 | 0.17 | 3.39 | 2.12 | 63% | 1.27 | 38% | Y |
| 19.41 | 0.18 | 3.46 | 2.19 | 63% | 1.27 | 37% | Y |
| 19.41 | 0.18 | 3.53 | 2.26 | 64% | 1.27 | 36% | Y |
| 19.41 | 0.18 | 3.46 | 2.26 | 65% | 1.20 | 35% | Y |
| 19.41 | 0.18 | 3.53 | 2.33 | 66% | 1.20 | 34% | Y |
| 19.41 | 0.18 | 3.46 | 2.33 | 67% | 1.13 | 33% | Y |
| 19.41 | 0.18 | 3.53 | 2.40 | 68% | 1.13 | 32% | Y |
| 19.41 | 0.18 | 3.46 | 2.40 | 69% | 1.06 | 31% | Y |
| 19.41 | 0.18 | 3.53 | 2.47 | 70% | 1.06 | 30% | Y |
| 19.41 | 0.18 | 3.46 | 2.47 | 71% | 0.99 | 29% | Y |
| 19.41 | 0.18 | 3.46 | 2.54 | 73% | 0.92 | 27% | Y |
| 19.41 | 0.18 | 3.53 | 2.61 | 74% | 0.92 | 26% | Y |
| 19.41 | 0.18 | 3.53 | 2.68 | 76% | 0.85 | 24% | Y |
| 19.41 | 0.18 | 3.53 | 2.75 | 78% | 0.78 | 22% | Y |
| 19.41 | 0.18 | 3.53 | 2.82 | 80% | 0.71 | 20% | N |
| 19.41 | 0.18 | 3.46 | 3.46 | 100% | 0.00 | 0% | N |
| 19.41 | 0.18 | 3.53 | 3.53 | 100% | 0.00 | 0% | N |

59

FIG. 19

62 60

| Pack Area (sq. in.) | Total Fill (oz) | Total Fill Density (oz/sq in) | PCM (oz) | PCM % | Water (oz) | Water % | Fit on 1.9" | Fit on 1.21" |
|---|---|---|---|---|---|---|---|---|
| 30.08 | 6.70 | 0.22 | 4.76 | 71% | 1.94007 | 29% | Y | N |
| 30.08 | 6.35 | 0.21 | 4.59 | 72% | 1.7637 | 28% | Y | N |
| 21.66 | 3.70 | 0.17 | 2.05 | 55% | 1.657878 | 45% | Y | Y |
| 21.66 | 4.30 | 0.20 | 2.54 | 59% | 1.7637 | 41% | Y | Y |
| 21.66 | 4.41 | 0.20 | 2.65 | 60% | 1.7637 | 40% | Y | Y |
| 21.66 | 3.88 | 0.18 | 2.33 | 60% | 1.552056 | 40% | Y | Y |
| 21.66 | 3.53 | 0.16 | 2.12 | 60% | 1.41096 | 40% | Y | Y |
| 21.66 | 3.99 | 0.18 | 2.40 | 60% | 1.58733 | 40% | Y | Y |
| 21.66 | 3.81 | 0.18 | 2.29 | 60% | 1.516782 | 40% | Y | Y |
| 21.66 | 4.41 | 0.20 | 2.75 | 62% | 1.657878 | 38% | Y | Y |
| 21.66 | 4.13 | 0.19 | 2.65 | 64% | 1.481508 | 36% | Y | Y |
| 21.66 | 4.23 | 0.20 | 2.75 | 65% | 1.481508 | 35% | Y | Y |
| 21.66 | 4.30 | 0.20 | 2.82 | 66% | 1.481508 | 34% | Y | N |
| 21.66 | 4.23 | 0.20 | 2.82 | 67% | 1.41096 | 33% | Y | N |
| 21.66 | 3.70 | 0.17 | 2.47 | 67% | 1.23459 | 33% | Y | N |
| 21.66 | 3.53 | 0.16 | 2.47 | 70% | 1.05822 | 30% | Y | N |
| 21.66 | 2.29 | 0.11 | 2.29 | 100% | 0 | 0% | Y | N |
| 21.66 | 2.12 | 0.10 | 2.12 | 100% | 0 | 0% | Y | Y |
| 19.41 | 3.10 | 0.16 | 1.83 | 59% | 1.269864 | 41% | Y | Y |
| 19.41 | 3.17 | 0.16 | 1.90 | 60% | 1.269864 | 40% | Y | Y |
| 19.41 | 3.25 | 0.17 | 1.98 | 61% | 1.269864 | 39% | Y | Y |
| 19.41 | 3.32 | 0.17 | 2.05 | 62% | 1.269864 | 38% | Y | Y |
| 19.41 | 3.39 | 0.17 | 2.12 | 63% | 1.269864 | 38% | Y | Y |
| 19.41 | 3.46 | 0.18 | 2.19 | 63% | 1.269864 | 37% | Y | Y |
| 19.41 | 3.53 | 0.18 | 2.26 | 64% | 1.269864 | 36% | Y | Y |
| 19.41 | 3.46 | 0.18 | 2.26 | 65% | 1.199316 | 35% | Y | Y |
| 19.41 | 3.46 | 0.18 | 2.33 | 67% | 1.128768 | 33% | Y | Y |
| 19.41 | 3.53 | 0.18 | 2.40 | 68% | 1.128768 | 32% | Y | Y |
| 19.41 | 3.46 | 0.18 | 2.40 | 69% | 1.05822 | 31% | Y | Y |
| 19.41 | 3.53 | 0.18 | 2.47 | 70% | 1.05822 | 30% | Y | N |
| 19.41 | 3.46 | 0.18 | 2.47 | 71% | 0.987672 | 29% | Y | N |
| 19.41 | 3.46 | 0.18 | 2.54 | 73% | 0.917124 | 27% | Y | N |
| 19.41 | 3.53 | 0.18 | 2.61 | 74% | 0.917124 | 26% | Y | N |
| 19.41 | 3.53 | 0.18 | 2.75 | 78% | 0.776028 | 22% | Y | N |
| 19.41 | 3.53 | 0.18 | 3.53 | 100% | 0 | 0% | N | N |
| 19.41 | 3.46 | 0.18 | 3.46 | 100% | 0 | 0% | N | N |

64

66

FIG. 20

THERMAL MODIFICATION DEVICE

BACKGROUND OF THE INVENTION

1. The Field of the Invention

The present invention relates to a wearable cooling system. More specifically, the present invention is directed to a wearable cooling system that is more thermally efficient, considerably lighter and more comfortable to wear than conventional cooling systems.

2. Background Art

Wearable cooling systems are evaluated based on their efficacy to cool their wearers, the amount of weight their wearers need to bear while donning the wearable cooling systems or articles of clothing containing wearable cooling systems and the level of comfort to wear as experienced by their wearers. Wearable cooling systems that are sought after are those that are light weight to reduce fatigue to the wearers, those that are capable of cooling over a prolonged duration and those that provide suitable rates of cooling to their wearers so that the wearers feel comfortable, e.g., not too cold or not too warm.

Wearable cooling products can be categorized into two segments, i.e., those which harness evaporation to remove excess body heat and those that use conduction to remove excess body heat. Evaporative systems are generally less costly and more lightweight but they lose their effectiveness in humid environments, cannot provide substantial cooling in severe environments and cannot function at all in workplace environments where body suits are needed for safety reasons.

In general, conduction systems take advantage of some form of a cooling pack placed close to the skin to draw heat away from the body by contact, examples of which include gel packs, ice packs, cold water and phase change material (PCM) packs. Each type of cooling pack has its advantages and disadvantages. For instance, gel packs remain in the liquid form and are pliable, allowing the packs to mold to the body for closer and more comfortable contact. However, due to the packs remaining in the liquid form, the amount of heat that the packs absorb as a measure of its total mass is very low. Due to their high latent heat of fusion, ice packs can absorb significant amounts of heat as a measure of their mass. However, the low temperature, e.g., 0 degrees Celsius/32 degrees Fahrenheit, is detrimental to direct contact with the skin and protective layers are needed to prevent the body from getting too cold. Also, by nature of the ice packs being frozen solid, they do not easily conform to the curvatures of the body.

Cold water systems require pumps to move the water through the vest. These systems are bulky and costly and are best suited for situations where the user is stationary, e.g., in a factory setting or a racecar, i.e., situations in which the weight of such setups are not born entirely by an individual. In PCMs, the advantages of the latent heat of fusion can be realized to allow them to provide longer-lasting cooling. However, unlike ice, PCMs allow the contact temperatures with the human skin to be configured to be more suited for the human body than the freezing temperature of water. Having a PCM that freezes at a higher temperature allows the PCM to be more safely disposed for direct skin contact and the cooling ability of the PCM lasts longer in hot environmental conditions without heat shielding on the exposed surfaces of the PCM.

Drawbacks reported by users of current conduction-based wearable cooling systems on the market have been that the cooling systems are heavy, uncomfortable to wear and they do not provide sufficient cooling power. Many cooling vests on the market weigh over 5 lbs or 2.26 kg. The excessive weight of the cooling vest makes them unlikely to be used unless in extreme situations when users elect to realize their cooling benefits over their excessive weight. If a cooling system is disposed in a solid, i.e., frozen, state, the mass creates two problems when used in a wearable device for the human body.

The solid mass creates fit issues as the human body is made up entirely of curvatures. This creates pockets where the solid mass is not disposed in contact with the skin of the body, inhibiting heat transfer by way of conduction. Further, the human body is always in perpetual motion, even in a static seating position. Breathing and other autonomic nervous system functions move our bodies enough to change our bodies' curvatures.

As such, even static form fitting molds would not create the fit required for the human body. As such, flexibility must be addressed to promote direct skin contact of the cooling system and thus not inhibit heat transfer to the cooling material of a cooling system. Currently, there exists some cooling packs configured to provide some flexibility to address curvatures of the human body, by way of heat-sealing divisions of cooling materials, perforations and dimples into cooling packs, creating smaller subdivisions in larger solid masses. These subdivisions improve flexibility but create areas which trap body heat and have no access to the cooling area, inhibiting heat transfer from the body to the cooling pack, which leads to the cooling pack not deemed sufficiently cold.

U.S. Pat. Pub. No. US20190142629A1 to Shinozaki (herein after Shinozaki) discloses a cooling pack intended to maintain the human body at a suitable low temperature and ensure a sufficient usage time. The cooling pack consists of a liquid buffer layer containing an antifreeze in contact with the skin, and an outer cold storage layer containing a PCM material. The PCM freezes at approximately 68° F. and transfers heat away from the buffer layer. The antifreeze consists of a salt NaCl or KCl dissolved in water, or it can be just water alone. The layers are divided into heat sealed sections, either long strips or a matrix of sections, and therefore suffer from an inability to conform precisely to the curvature of the body and so form hotspot areas where the sections are not in contact with the skin. Furthermore, the antifreeze has the potential to cause skin irritation and burns if leaks develop which allow the antifreeze to contact the skin. When used to cool the head, antifreeze leaks have the potential to cause eye irritation.

There is a need for a cooling device that eliminates heat sealed divisions in the layers, i.e., articulation mechanisms between layer sections, and so conforms better to the curvature of the human body, is lightweight, is comfortable to wear, with long-lasting cooling ability.

SUMMARY OF THE INVENTION

In accordance with the present invention, there is provided a thermal modification device for modifying the skin temperature of a user, the thermal modification device including:

(a) a first elongated flexible container including a first substance disposed therein and a first wall and a second wall, wherein the first substance is a fluid having thermal properties of a first substance; and (b) a second elongated flexible container including a second substance disposed therein and a first wall and a second wall, wherein the second substance is a fluid having thermal properties of a second substance, wherein a ratio of the mass of the first substance and the mass of the second substance is at least one of about 0.22 and about 0.31, the first elongated flexible container and the second elongated flexible container are disposed with the second wall of the first elongated flexible container disposed in contacting relationship with the first wall of the second elongated flexible container and the first wall of the first elongated flexible container is configured to be disposed in contacting relationship with the user such that thermal exchanges occur between the skin of the user, the first substance and the second substance to modify the skin temperature of the user.

In one embodiment, the second wall of the first elongated flexible container is the same as the first wall of the second elongated flexible container. In one embodiment, the first substance is water. In one embodiment, the second substance is a phase change material (PCM). In one embodiment, the PCM is a material having a melting point that falls in the range of about 9.5° C. to about 21° C. In one embodiment, each of the second wall of the first elongated flexible container and the first wall of the second elongated flexible container includes a heat transfer surface of about 8.625 inches in length and about 2.25 inches in width. In one embodiment, the second substance is configured to be disposed at a temperature at or higher than about 49 degrees F. prior to the use of the thermal modification device. In one embodiment, the thermal modification device is configured to be flexible such that an arc of at least about 1.21 inches can be formed in the first wall of the first elongated container when the thermal modification device is disposed at about 49° F. In one embodiment, the thermal modification device further includes a length of up to about 14 inches. In one embodiment, the thermal modification further includes an aggregate weight of the first substance and the second substance per unit area of the first wall of the first elongated flexible container of no more than about 0.20 ounces per square inch. In one embodiment, the thermal modification device further includes an aggregate weight of the first substance and the second substance per unit area of the first wall of the first elongated flexible container of no more than about 0.18 ounces per square inch. In one embodiment, an aggregate weight of the first substance and the second substance is no more than about 2 lbs.

An object of the present invention is to provide an effective thermal modification device for humans.

Another object of the present invention is to provide a thermal modification device for humans that is comfortable to wear and capable of long-lasting cooling.

Another object of the present invention is to provide a thermal modification device for humans that is light weight, and conforms closely to the curvature of the body without subdivisions, e.g., articulation mechanisms, between layer sections to eliminate hot spots.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 18 discloses testing done by the Applicant on a cooling pack of width of about 2.25 inches and a length of about 8.625 inches, for various ratios of PCM and water to determine whether a bend radius of about 1.21-inch, as required to be used with a wrist and an ankle, is possible;

FIG. 19 discloses test results on a cooling pack of width of about 2.25 inches and a length of about 8.625 inches, for various ratios of PCM and water, indicating whether or not the cooling pack can be bent to satisfy a bend radius of about 1.9-inch, i.e., a bend radius suitable for most common applications; and FIG. 20 discloses test results on cooling packs including those of sizes other than ones with a width of about 2.25 inches, depicting the effects fill density has on the ability of the cooling packs to achieve two different bend radii.

PARTS LIST

2—phase change material (PCM)
4—cooling zone
6—trapped heat zone
8—perforations or dimples
10—curved body part
12—contact surface
14—flexible container
16—body surface to be cooled
18—water layer
20—PCM layer
22—contact point
24—radius of thermal modification device
26—user
28—pocket
30—stretch fabric
32—first wall or sheet of first elongated container
34—median wall or aggregate of second wall or sheet of first elongated container and
first wall or sheet of second elongated container
36—second wall or sheet of second elongated container
38—length of thermal modification device
40—width of thermal modification device
42—radius of human anatomical part
44—circumference representing curvature of an ankle
46—circumference representing curvature of a forearm
48—circumference representing curvature of an upper arm
50—circumference representing curvature of a neck
52—circumference representing curvature of a head
54—circumference representing curvature of a thigh
56—circumference of an arc representing a thermal modification device
58—test data using a mass ratio of first substance to second substance of about 0.31
59—test data using a mass ratio of first substance to second substance of about 0.22
60—column indicating whether an arc of a specified bend radius of 1.21 inches can be formed
62—column indicating whether an arc of a specified bend radius of 1.9 inches can be formed
64—test data showing fill density allowing bend radii of 1.21 inches and 1.9 inches to be achieved with fill area of 21.66 square inches
66—test data showing fill density allowing bend radii of 1.21 inches and 1.9 inches to be achieved with fill area of 19.41 square inches Particular Advantages of the Invention In one embodiment, the present thermal modification device utilizes a phase change material (PCM) layer in contact with a water layer that is in contact with a user's skin surface. This allows for direct and comfortable skin contact with the present thermal modification device while the present thermal modification device provides sufficient cooling power and can be formed into suitable shapes that avoid air gaps that lower cooling efficiencies. The present thermal modification device is configured to be placed in stretch fabrics, allowing for a closer contact of the present thermal modification device to the body, thereby allowing for reduced amounts of the PCM to provide a similar level of cooling as other cooling vests that contain significantly more the amount of cooling materials.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
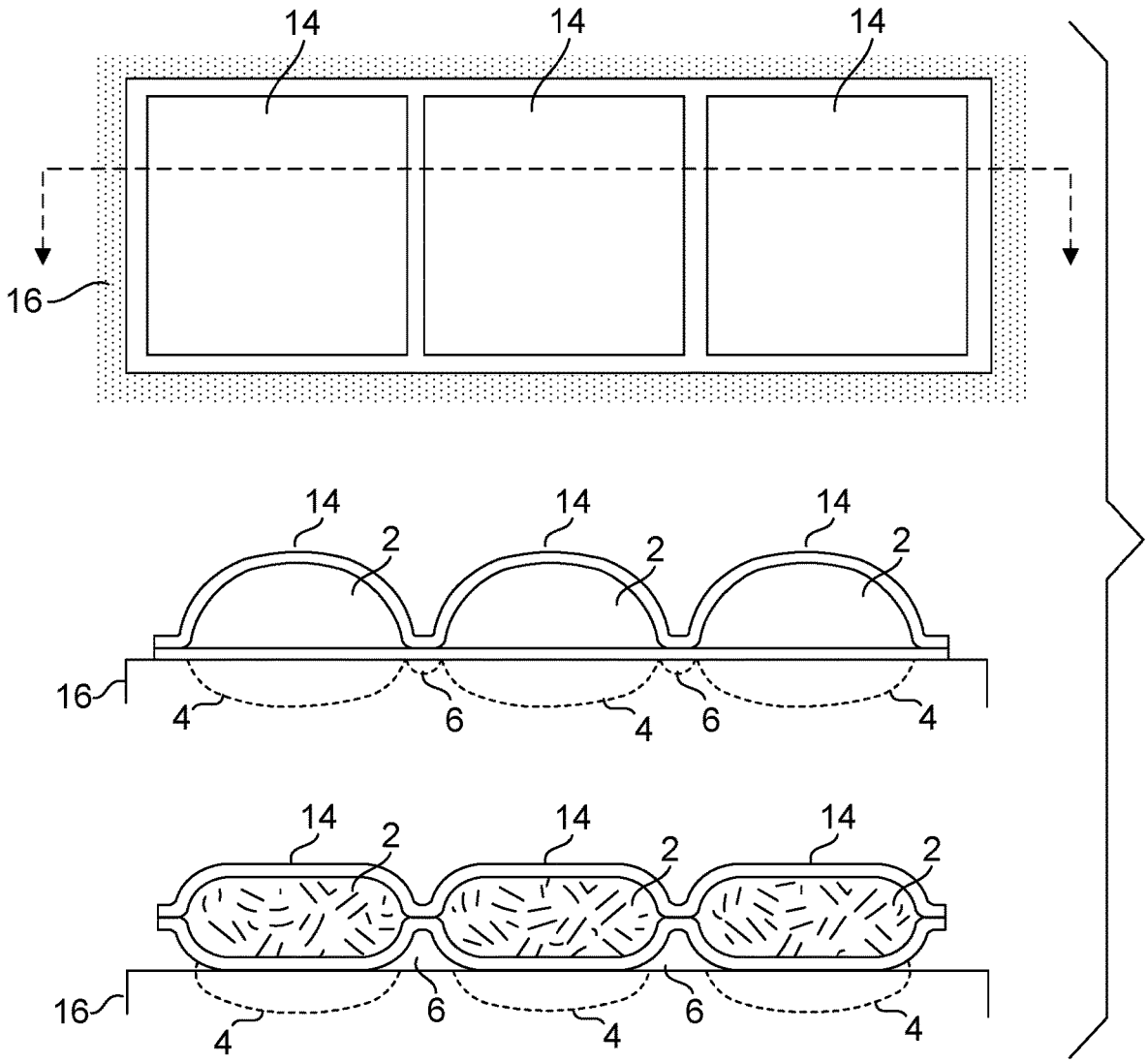
PRIOR ART FIG. 1
FIG. 1 is a top and two side cross-sectional views of two commonly used construction methods of cooling packs employing heat-sealed divisions as articulation mechanisms to facilitate the use of the cooling packs on curvatures.

FIG. 1 is a top and two side cross-sectional views of two embodiments of a prior art thermal modification device using a phase change material (PCM)-filled containers or compartments for cooling a body surface 16, employing heat-sealed divisions of the containers as articulation mechanisms to facilitate curvature. In the top view, it shall be noted that the flexible containers 14 are filled with PCM cooling materials 2. A section through the top view is shown in each of the side views where two embodiments are shown. The first of the two embodiments shown in a cross-sectional view includes a flat lower sheet with a formed upper sheet. The second of the two embodiments shown in a cross-sectional view includes upper and lower formed sheets. Here, it shall be noted that cooling zones 4 are formed in the skin surface as shown and trapped heat zones 6 are formed under the heat-sealed divisions of the upper and lower sheets between containers. Trapped heat zones are very inefficient and undesirable since air is a poor conductor. These reduce the efficacy of the thermal modification device, resulting in the need for added cooling containers that increase the weight and bulk of device.

Figure 2:
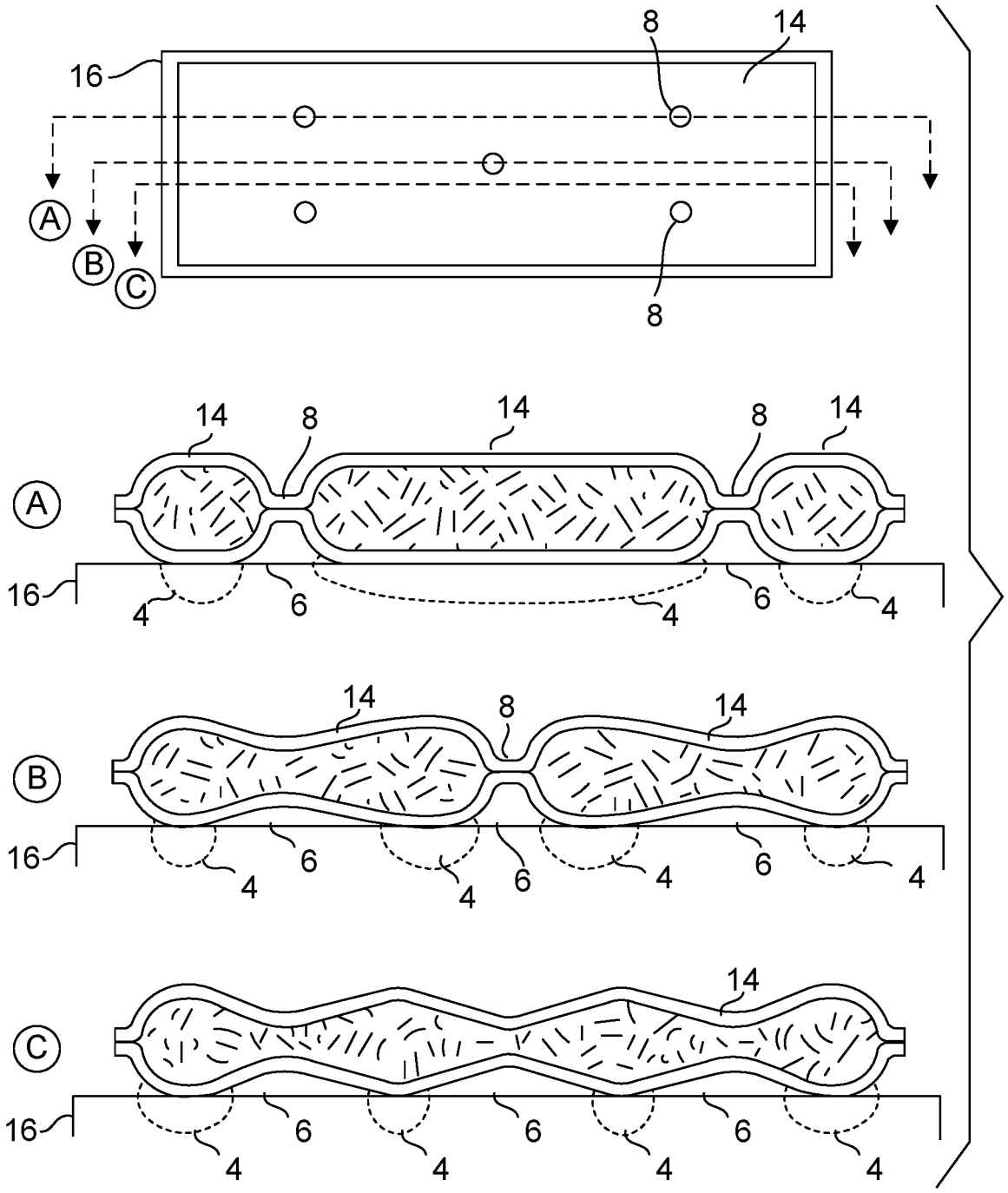
PRIOR ART FIG. 2
FIG. 2 is a top and three side cross-sectional views of the commonly used construction methods of cooling packs employing dimples as articulation mechanisms to facilitate the use of the cooling packs on curvatures.
Figures 3, 4:
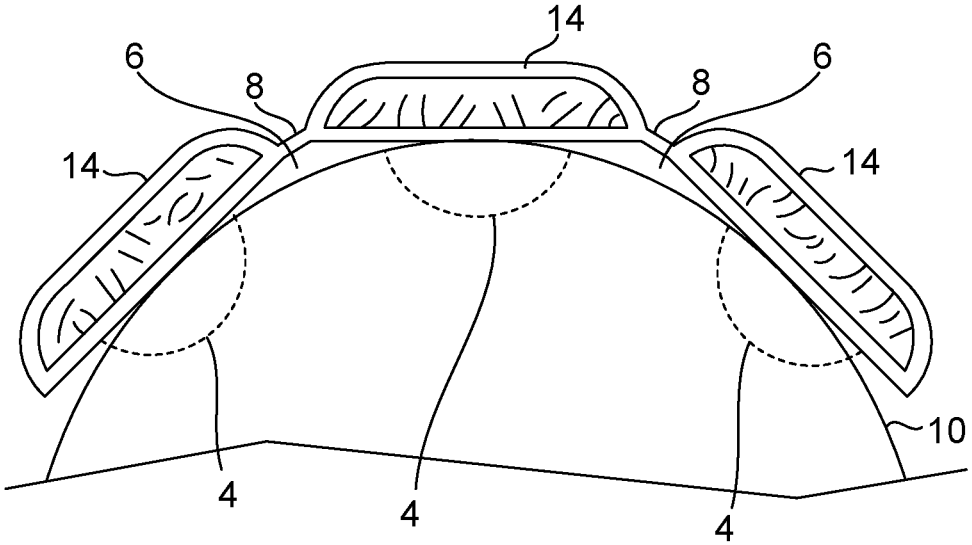
PRIOR ART FIG. 3
FIG. 3 shows a cooling pack employing dimples as articulation mechanisms on a severely curved surface, e.g., a person's head.
FIG. 4 is a tabular comparison of the heat capacity and heat of fusion of water and 21C phase change material (PCM)

FIG. 2 is a top and side cross-sectional view of another embodiment of a prior art thermal modification device employing dimples 8 at various locations as articulation devices to facilitate curvature of a body surface. Cross-sections of the thermal modification device are shown at sections A, B, and C. It shall be apparent that trapped heat zones 6 are numerous, and cooling zones 4 are reduced in some sections. FIG. 3 is a side cross-sectional view of yet another embodiment of a prior art thermal modification device applied to a severely curved surface, e.g., a person's head or arm.

The trapped heat zones 6 become enlarged and the cooling zones 4 are greatly reduced in area. It shall be apparent that users of this embodiment of the thermal modification device are generally not pleased with the cooling efficacy of the thermal modification device, and an improved cooling device is needed.

Figure 5:
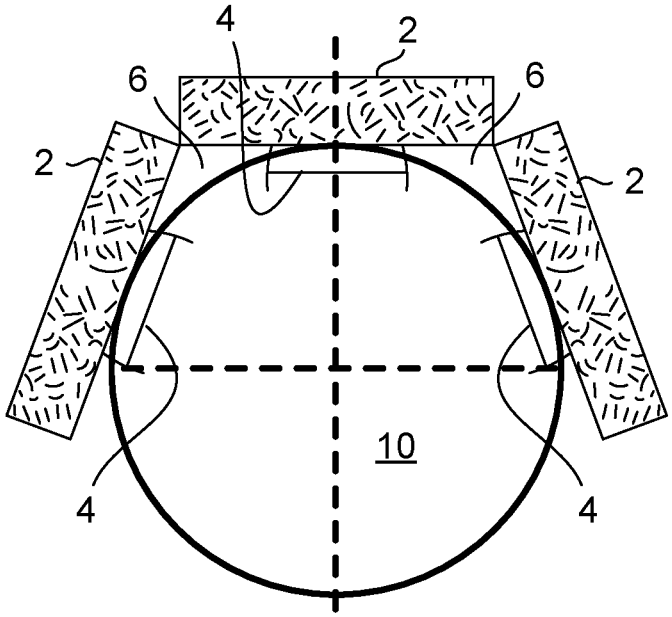
PRIOR ART FIG. 5
FIG. 5 is a cross-sectional diagram of an inflexible articulated PCM cooling layer configured to be on the surface of a severely curved body part, e.g., a person's head, arm, or thigh.

FIG. 5 is a cross-sectional diagram of an inflexible articulated PCM cooling layer configured to be on the surface of a severely curved body part, e.g., a person's head, arm, or thigh. The contact area and cooling zones are greatly reduced, e.g., by a factor of two, and the trapped heat zones greatly increased. Based on a heat flux equation for conduction cooling of (thermal conductivity×cooling area× change in temperature)/thickness of material, the heat flux through a device shown in FIG. 5 is reduced by more than 50% compared to a device capable of suitable contact with the skin as the cooling area is severely reduced in the scenario shown in FIG. 5 due to the inability of the device in conforming with the skin, highlighting the need for suitable contact of the device with the skin. Clearly, flexibility of the cooling layer of a cooling device must be better addressed to promote direct skin contact of the cooling system and thus not inhibit heat transfer to the cooling material of a cooling system. Currently, cooling packs are configured to provide some flexibility to address curvatures of the human body, by way of heat-sealing divisions of cooling materials, perforations and dimples into cooling packs, creating smaller subdivisions in larger solid masses. These subdivisions improve flexibility but create areas which trap body heat and have no access to the cooling area, inhibiting heat transfer from the body to the cooling pack, which leads to the cooling pack not deemed sufficiently cold. Therefore, it shall be seen that, in order to solve this long felt need for a cooling device that is comfortable to wear but with prolonged cooling, care must be taken to ensure that the weight of the cooling device is minimize, the flexibility of the cooling device is increased such that cooling by conduction is possible and the cooling device does not lose its cooling efficacy after only its brief use.

In order to ensure the weight of the present thermal modification device is as little as possible, it is important to make sure that the mass of the cooling material is used as efficiently as possible. This makes it necessary to use a material that melts from a frozen state to a liquid state over the course of its use by a wearer. The absorption of energy, i.e., the latent heat of fusion, through the melting process, is orders of magnitude greater per gram of material than the heat capacity of the materials in its liquid form. For instance, referring to FIG. 4, the latent heat of fusion for water is 333.55 J/g while its heat capacity is 4.182 J/g*AC. The latent heat of fusion for 21C PCM is 190 J/g while its heat capacity is 2.3 J/g*AC. Many users found that prior art cooling packs did not feel cold enough to justify the use of vests equipped with cooling packs. In reality, the human body does not have neuroreceptors capable of determining the temperature of another object. In essence, when the human body experiences a cold or hot substance, it is measuring the rate of heat transfer to or from the body. This is the reason a metal spoon will "feel" cooler to a human body than a plastic utensil if they are both left in an environment at the same temperature. The metal spoon has a thermal effusivity of around 20 (KJ/m^2K√s) whereas a plastic spoon has a thermal effusivity of around 0.6 (KJ/m^2K√s). This means that the metal spoon can exchange heat faster with one's skin, making the metal spoon feel colder. In wearable cooling technology, there are many factors that can lead to this phenomenon, i.e., one portion of a cooling pack "feels" colder than another. First, the subdivisions used to improve the flexibility of the frozen solid packs produce areas where no cooling material is present against the skin. Without contact, there is no transfer of heat from one material to another. Second, the solid materials folding along the subdivisions, create air gaps between the human body and the cooling material. These air gaps act to further insulate the cooling material from the body as air is a poor heat conductor as its thermal effusivity is about 0.006 (KJ/m^2K√s), i.e., a value significantly lower than the thermal effusivity of metal, an excellent thermal conductor.

The importance of temperature at which a cooling material is disposed is also critical in the efficacy of a cooling process. The lower the temperature of the cooling material, the higher the rate of transfer of heat from the body to the object. However, the human body has evolved to counteract the threat of hypothermia through the autonomic nervous system. Blood vessels constrict in the presence of colder temperatures to keep our body temperatures at 98.6° F. Therefore, using a cooling material that is too cold will reduce the blood flow to the area and thus reduce the heat exchange capabilities of the cooling material. For this reason, ice is a poor material for wearable cooling technology despite its substantial thermal energy storage capacity.

Figure 6:
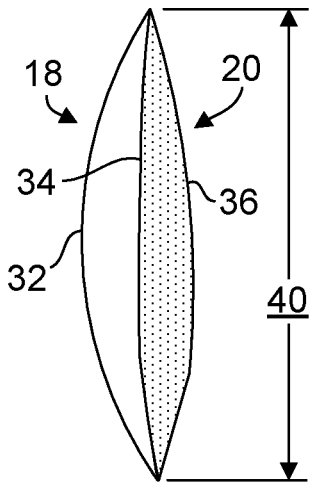
FIG. 6 is a cross-sectional view of a thermal modification device with two containers formed adjacent to one another.
Figure 7:
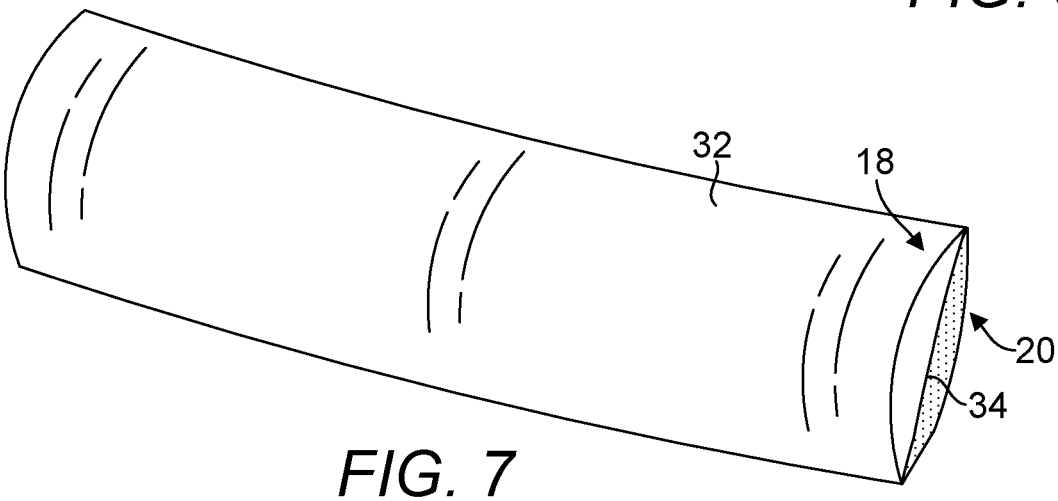
FIG. 7 is a front perspective view of the thermal modification device shown in FIG. 6.
Figure 8:
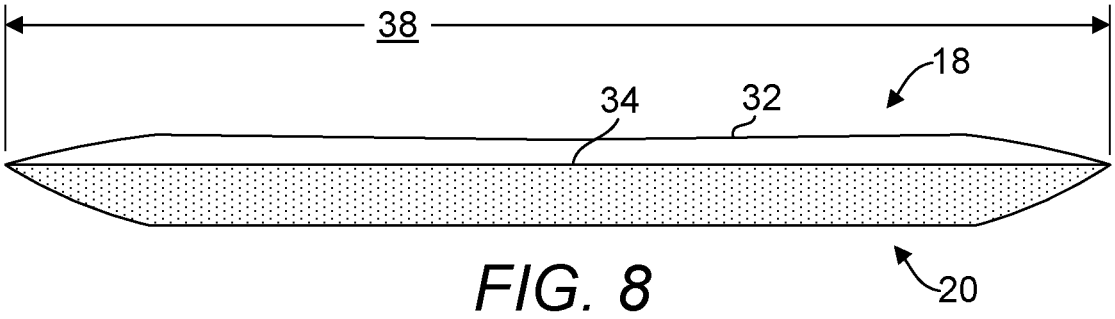
FIG. 8 is a top view of the thermal modification device shown in FIG. 6.
Figure 9:
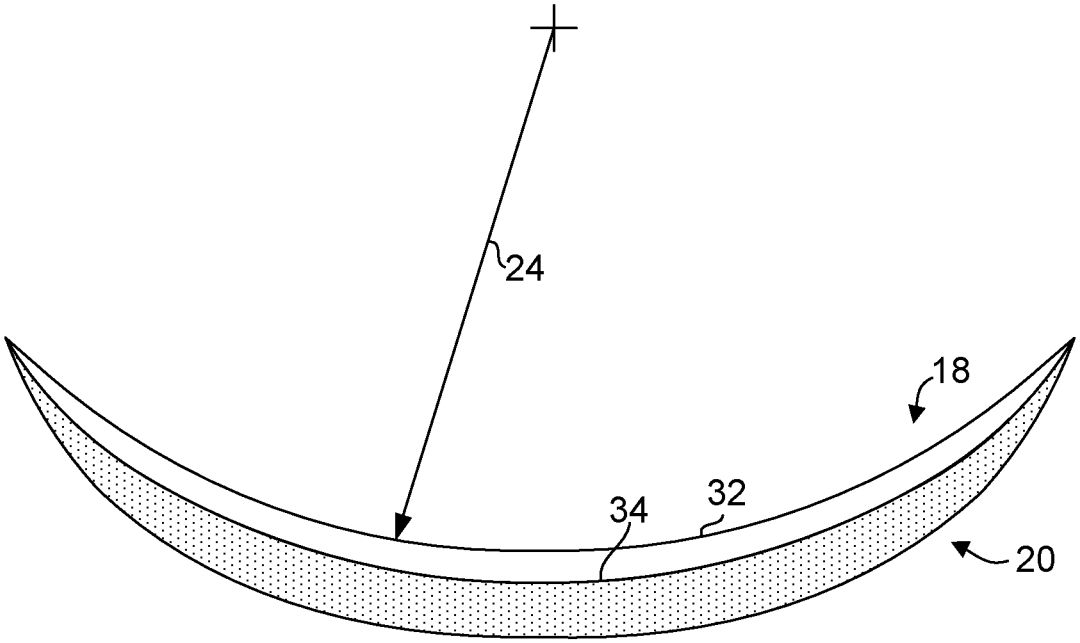
FIG. 9 is a top view of the thermal modification device shown in FIG. 6 where the device is shown disposed in a configuration suitable to be used with a curved portion of a human body.
Figure 10:
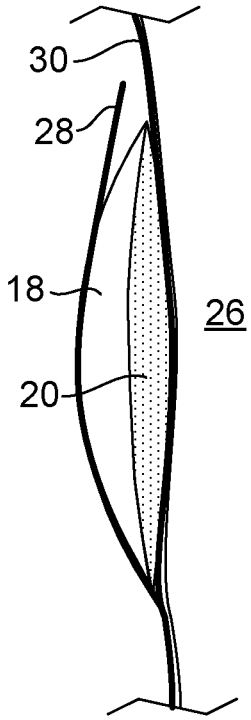
FIG. 10 is a side cross-sectional view of a pocket by which a thermal modification device is secured for use in cooling a user.

FIG. 6 is a cross-sectional view of a thermal modification device with two containers formed adjacent to one another. The barrier or wall between the contents of the two elongated flexible containers 18, 20 of the thermal modification device is preferably a single sheet capable of structurally separating the two contents while sufficiently thin, e.g., with a thickness of about 10 mils, so as not to act as a significant thermal barrier between the two contents. In another embodiment, two containers are joined together, e.g., at their broad faces, by adhesive or by fusion, to form a barrier having equivalent structural thermal properties. FIG. 7 is a front perspective view of the thermal modification device shown in FIG. 6. FIG. 8 is a top view of the thermal modification device shown in FIG. 6. FIG. 9 is a top view of the thermal modification device shown in FIG. 6 where the device is shown disposed in a configuration suitable to be used with a curved portion of a human body. It shall be noted, with suitable configuration of the contents of the two layers, i.e., the water layer 18 and the PCM layer 20 that the thermal modification device is capable of assuming and maintaining the shape of the thermal modification device when disposed at suitable temperature for cooling and when it has been bent to this shape. FIG. 10 is a side cross-sectional view of a pocket 28 by which a thermal modification device is secured for use in cooling a user. It shall be noted that a vest useful for holding or securing the thermal modification device is constructed from stretched fabric 30. While in use, the fabric coming in contact with the thermal modification device shall be disposed tightly against the user 26, minimizing the formation of air gaps between the thermal modification device and the user 26. In use, it is beneficial to have a pocket 28 constructed from stretched fabric to assist in compressing the thermal modification device against the user 26.

Figure 11:
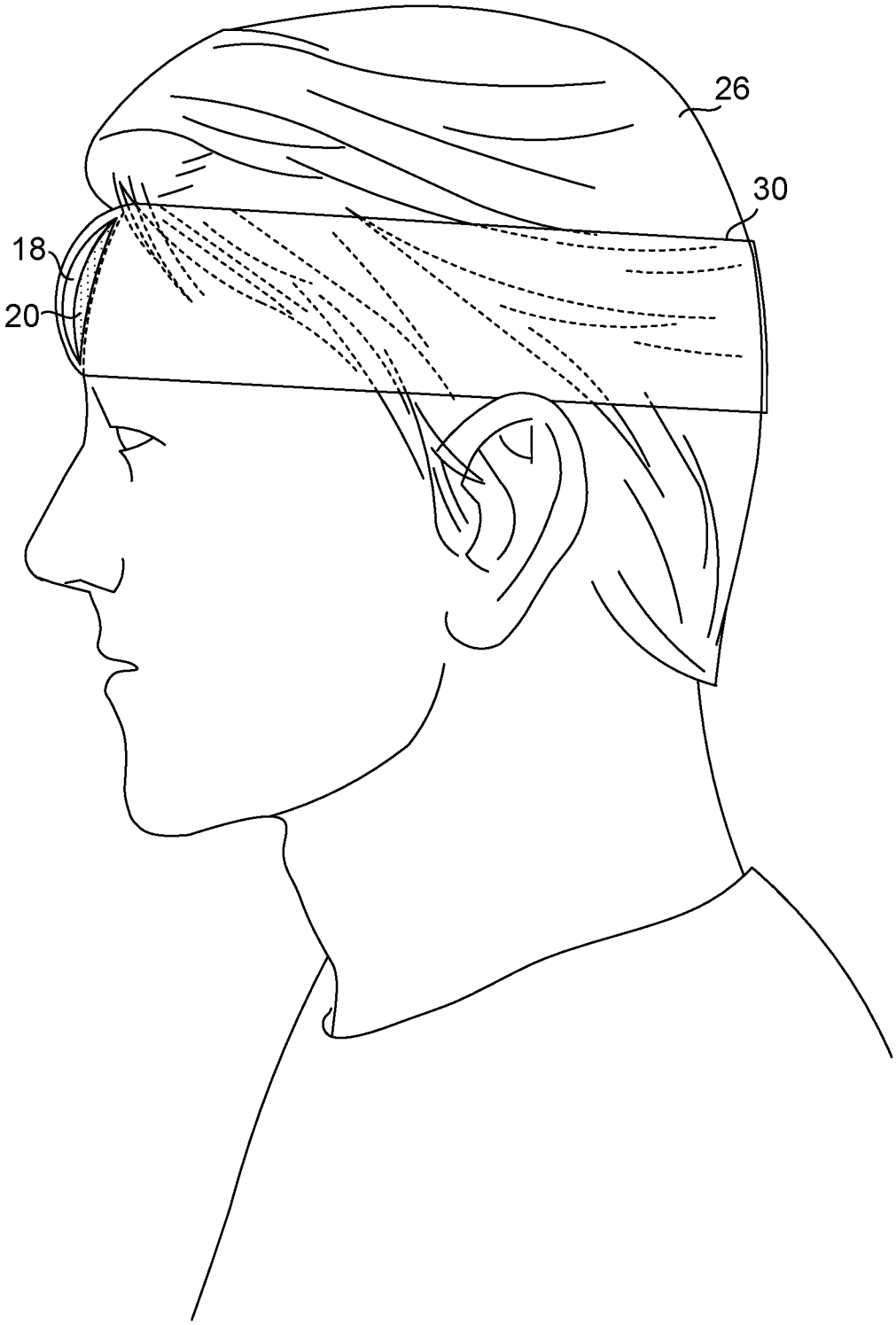
FIG. 11 shows a user wearing a cooling pack shown in FIG. 7 as a headband.

FIG. 11 shows a user wearing a cooling pack shown in FIG. 7 as a headband constructed from stretched fabric 30 wherein only a cross-section of the thermal modification device is shown disposed on the forehead for clarity although the thermal modification device would be wrapped around the forehead forming an arc that minimizes air gaps between the thermal modification device and the user's forehead.

Figure 12:
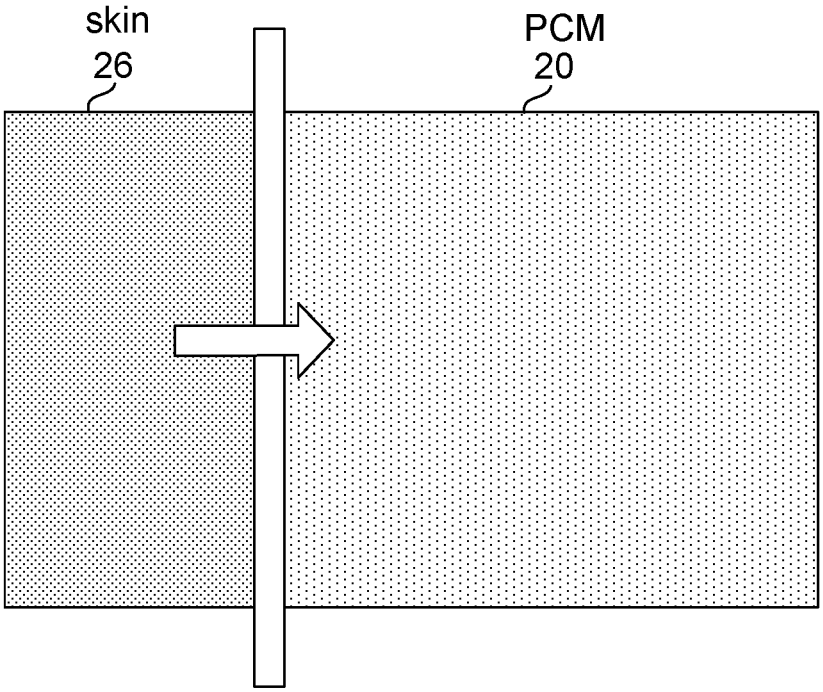
FIG. 12 is a schematic diagram depicting heat transfer from skin to a PCM layer where the arrow indicates the direction and magnitude of heat flow.
Figure 13:
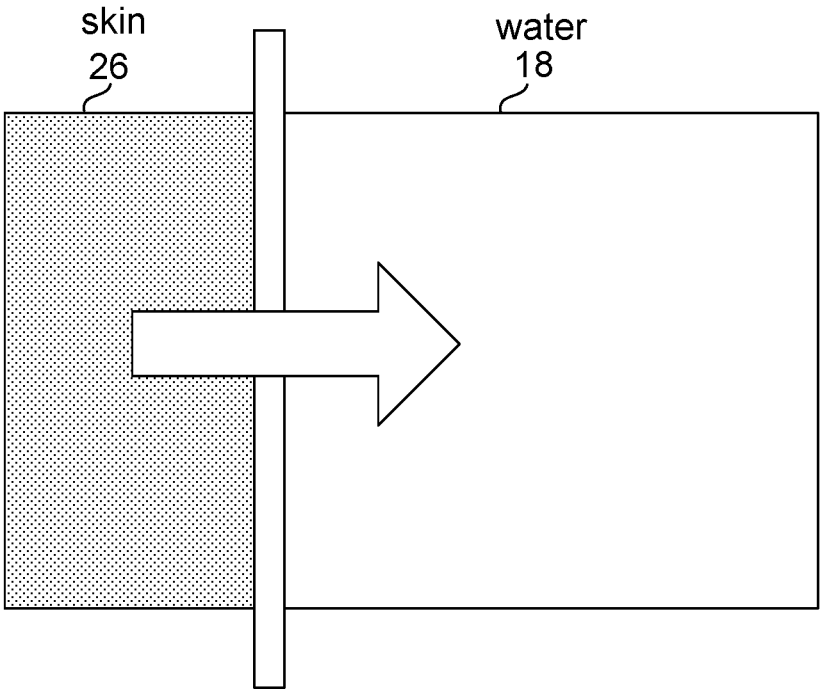
FIG. 13 is a schematic diagram depicting heat transfer from skin to a water layer where the arrow indicates the direction and magnitude of heat flow.
Figure 14:
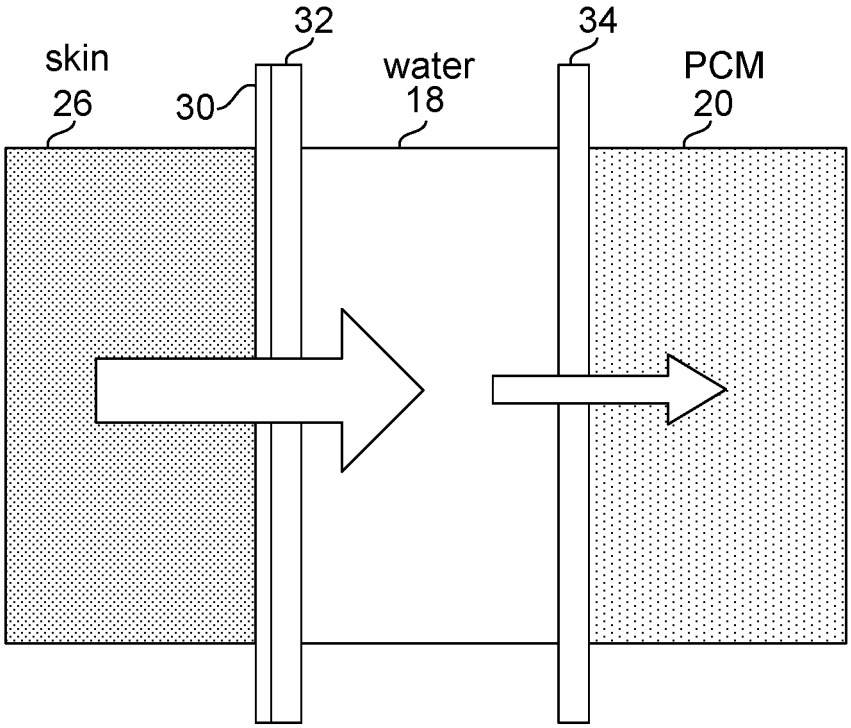
FIG. 14 is a schematic diagram showing heat transfer from skin to a water layer and then to a PCM layer in contact with the water layer where arrows indicate the direction and magnitude of heat flow.

FIGS. 12, 13, and 14 highlight the total energy absorption and rate of heat transfer differences between a frozen PCM system, a liquid water system, and the present thermal modification device employing a water layer and a PCM layer, in a cooling pack with dimensions 2.5 inches×10 inches. FIG. 12 shows a frozen PCM layer in contact with skin. The PCM layer has a thermal effusivity of 0.582, a specific heat solid of 2.1 J/g*ΔC, and a latent heat of fusion of 190 J/g. Due to the low thermal effusivity of frozen PCM, heat from the body slowly exchanges with the PCM. The latent heat of fusion allows the PCM to absorb more heat than water before temperatures equalize (see FIG. 4 for properties). For instance, for 120 g of PCM, the total energy absorption=120 g×190 KJ/kg=22,800 Joules. The rate of heat transfer from skin=(thermal conductivity×cooling area×change in temperature)/thickness of material=(0.18 J/(m^2*° C.)*0.0139 m^2*14° C.)/0.05 m=0.7 J/s. The area of 0.0139 m^2(21.65 in^2) was taken from an example application in which a cooling pack with dimensions of 2.5 inches×10 inches heat transfer surface and a thickness of 0.05 m.

FIG. 13 shows a water (liquid) layer in contact with skin. The water layer has thermal effusivity of 1.58, and a specific heat liquid of 4.182 J/g*AC. Due to the high thermal effusivity of water, heat from the body moves quickly to the water layer. Due to the water already being liquid, it can absorb significantly less heat than the PCM layer. For 120 g of water, the total energy absorption=120 g×(4.182 J/g*AC)×14° C.)=7025 Joules. The rate of heat transfer from skin=(thermal conductivity×cooling area×change in temperature)/thickness of material=(0.58 J/(m^2*° C.)*0.0139 m^2*14° C.)/0.05 m=2.26 J/s. The area of 0.0139 m^2(21.65 in^2) was taken from an example application in which a cooling pack with dimensions of 2.5 inches×10 inches heat transfer surface and a thickness of 0.05 m.

The present thermal modification device combines the best features of FIGS. 12 and 13 to result in a heat transfer scenario depicted in FIG. 14. It employs a water liquid layer in contact with the skin with an outer frozen PCM layer. In use, due to the high thermal effusivity of water, heat from the body quickly moves to the water layer. However, the high specific heat capacity of liquid water means that it takes a long time for the water temperature to increase. This allows the frozen PCM to cool the water. The total energy absorption at 25% water and 75% PCM=(30 g*(4.182*14° C.))+(90 g*190 KJ/kg)=18856 Joules. The present thermal modification device, with the water layer in contact with skin, is able to move heat away from, i.e., cool the skin faster than with the PCM layer alone in contact with the skin. The present thermal modification device is able to absorb a significantly larger amount of energy from the skin than water alone can do, and nearly as much as a single PCM layer can do. The benefits to the user are a more comfortable apparel to wear, neither too cool nor too hot, and a cooling apparel that lasts longer in time and weighs less than others on the market. It shall be noted that although the of two different media for the present thermal modification device may not result in the maximization of both heat transfer rate and the total energy absorption, the resulting configuration with the use of the two media, provides a thermal modification device which is sufficiently flexible to conform to one's body and sufficiently comfortable to wear. Due to the problem of weight, the present thermal modification device must weigh less than about 2 lbs (0.9 kg). This keeps the user from being over encumbered by the cooling device. Due to the shape of the body, and the average human torso width of 14 inches, the size of a single cooling pack should not exceed 14 inches in any dimension. The present thermal modification device utilizes two pouches of stretch fabric organized in sequence next to the skin. The skin-side layer remains a liquid allowing for more direct surface contact with the skin, and the liquid layer has a high thermal effusivity allowing body heat to move into this layer quickly. These two factors improve the comfort and rate of heat transfer problems disclosed elsewhere herein. The outer layer serves to provide the maximum thermal mass by being a frozen layer. It will absorb heat from the liquid (water) layer allowing the liquid layer to absorb more heat from the body. The greater thermal mass of a frozen layer ensures that the pack's weight remains manageable for the cooling time. The outer layer will be a PCM layer that has considerably more mass than the inner water layer that is in direct contact with the skin. Applicant discovered that the mass ratio of water to PCM of at least about 0.22 or at least about 0.31 is suitable for desired heat transfer properties while allowing the thermal modification device to sufficiently flex to achieve a bend radius of 1.9 inches and 1.21 inches, respectively, although the mass ratio may vary depending on the dimensions of the layers and application. For example, the mass ratio of a cooling device to wrap around a person's head may vary from that of a cooling device to wrap around a person's leg, or torso. It is important that the mass ratio be chosen appropriately to permit the cooling device to be bent sufficiently to conform to the body surface to be cooled. The present thermal modification device is configured to be flexible such that an arc with a minimum radius of about 1.21 inches can be formed in the wall of the water layer that contacts the skin without breaking the outer frozen PCM layer, ensuring it can conform to most surfaces of the human body such as an ankle, forearm, neck, head, or thigh, without the need of divisions. This also improves comfort for the user and heat transfer by preventing air gaps which reduce the heat transfer. This is achieved by managing the total mass of the cooling pack as a ratio to its surface area, some test results of which are shown in FIG. 20.

In use, the skin side liquid layer will start off at the same temperature as the frozen layer. However, it will quickly reach an equilibrium temperature halfway between the skin temperature, 33° C. (91.4° F.) and that of the PCM. Therefore the PCM layer should not be below 9.5° C. (49° F.) so that the water layer is not below 21° C. (70° F.). In order for the skin side liquid layer to have enough mass to allow for conforming to the body it must make up about 30% of the mass of the entire cooling pack. This ratio also ensures that the bending radius of the cooling pack will allow a minimum of about 1.21 inches bending radius needed for an ankle or wrist. Applicant discovered that any PCM material having a melting point that falls in the range of about 9.5° C. to about 21° C., is suitable for use in the PCM layer, inclusive of these temperatures.

Figure 15:
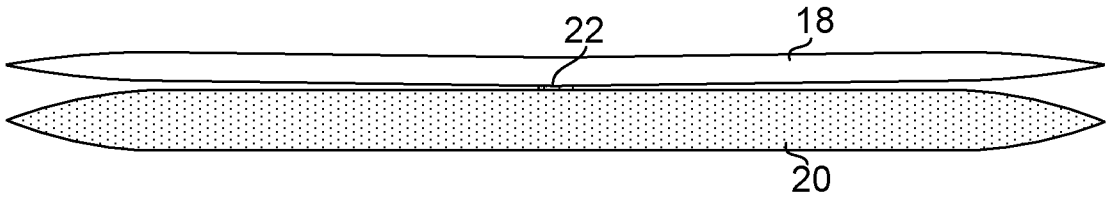
FIG. 15 is a side view of two elongated flexible containers in contact at their center only by means of a bead of adhesive or by fusion.
Figure 16:
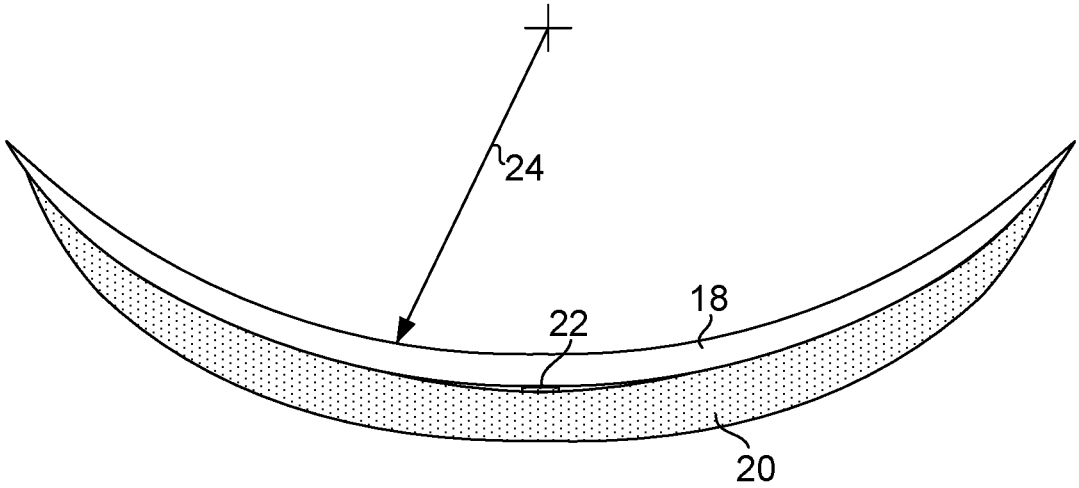
FIG. 16 is a side view of the two elongated flexible containers of FIG. 15 where the device is shown disposed in a configuration suitable to be used with a curved portion of a human body.

FIG. 15 is a side view of two elongated flexible containers in contact at their center only by means of a bead of adhesive or by fusion. The layers are attached at one point 22 or line 22 (extending along the width of the layers) by a bead of adhesive or by heat fusion. FIG. 16 is a side view of the two elongated flexible containers of FIG. 15 where the device is shown disposed in a configuration suitable to be used with a curved portion of a human body. Attaching the two layers at only one point allows the layers to slide with respect to each other during bending, in order to facilitate the desired flex radius.

Figure 17A:
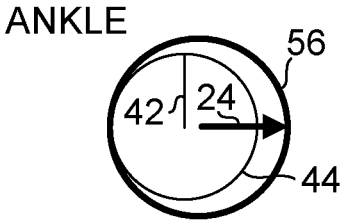
FIGS. 17A-17F is a series of diagrams disclosing the Applicant's measurement of the circumference of the cross-sections of various body parts, approximated as circles, capable of holding cooling devices.
Figure 17B:
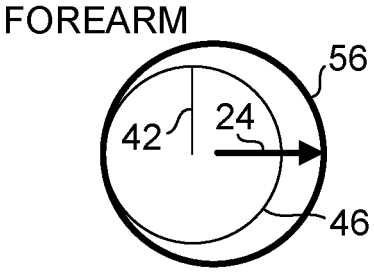
Figure 17C:
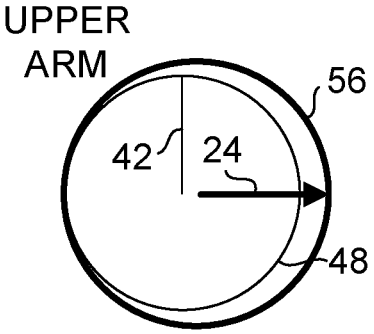
Figure 17D:
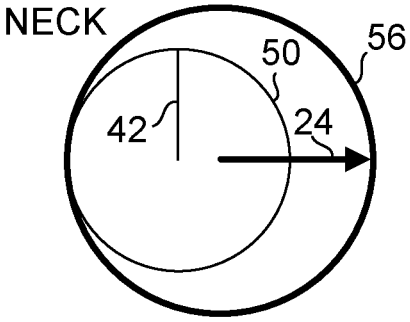
Figure 17E:
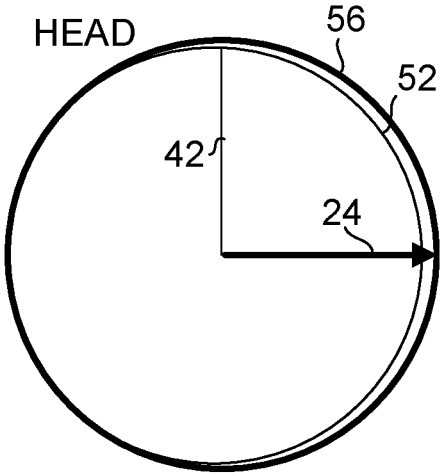
Figure 17F:
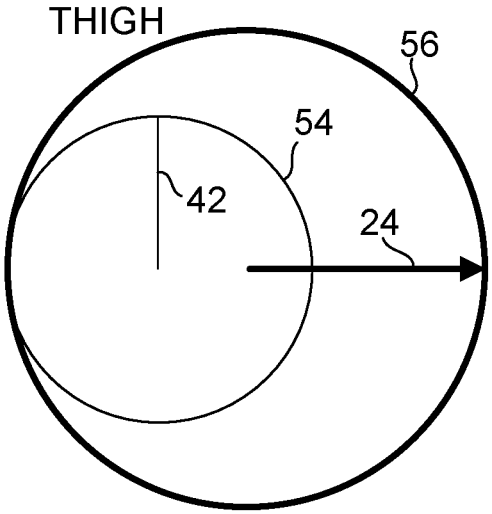

FIGS. 17A-17F is a series of diagrams disclosing the Applicant's measurement of the circumference of the cross-sections of various body parts, approximated as circles 44, 46, 48, 50, 52, 54, capable of holding cooling material e.g., ankle, as shown in FIG. 17A, forearm, as shown in FIG. 17B, upper arm, as shown in FIG. 17C, neck, as shown in FIG. 17D, head, as shown in FIG. 17E and thigh, as shown in FIG. 17F. These circumferences of a circle represent the arcs a cooling pack must conform to in order to fit onto these locations in the body. It shall be noted that the ankle and forearm require the most severe bending with a radius of about 1.21 in.

FIG. 18 discloses test results on a cooling pack of width of about 2.25 inches and a length of about 8.625 inches, i.e., dimensions Applicant found to be suitable for use with most individuals, e.g., dimensions for a cooling pack useful to be disposed on one's forehead as shown in FIG. 11, for various ratios of PCM and water, indicating whether or not the cooling pack can be bent to satisfy a bend radius of about 1.21-inch, i.e., a bend radius as required to be used with, e.g., a wrist or an ankle of a human. It shall be noted that at a mass ratio of the first substance to the second substance of at least about 0.31 (or 31% water by weight), the thermal modification device becomes sufficiently flexible such that it can be manipulated or bent to form an arc with the minimum bend radius 24 of about 1.21-inch to accommodate the maximum curvature of the body at the wrist or ankle. Note on row 58 that the result indicated in column 60 shows that the arc of the specified radius of 1.21-inch can be formed while all the other combinations below it, are unsuitable for forming an arc with this radius.

FIG. 19 discloses test results on a cooling pack of width about 2.25 inches and a length of about 8.625 inches, for various ratios of PCM and water, indicating whether or not the cooling pack can be bent to satisfy a bend radius of about 1.9-inch, i.e., a bend radius suitable for most common applications. It shall be noted that at a mass ratio of the first substance to the second substance of at least about 0.22(or 22% water by weight), the thermal modification device becomes sufficiently flexible such that it can be manipulated or bent to form an arc with the minimum bend radius 24 of about 1.9-inch to accommodate the maximum curvature of the body at the wrist or ankle. Note on row 59 that the result indicated in column 62 shows that the arc of the specified radius of about 1.9-inch can be formed while all the other combinations below it are unsuitable for forming an arc with this radius.

FIG. 20 discloses test results on cooling packs including those of sizes other than ones with a width of about 2.25 inches, depicting the effects fill density has on the ability of the cooling packs to achieve two different bend radii. It shall be noted that as a pack fill area increases, e.g., from about 19.41 square-inch fill area to about 21.66 square-inch fill area, the pack can hold more materials while still allowing flexibility although at a higher water-PCM mass or weight ratio. For instance, with the increased fill area of the latter, the mass ratio allowing the pack to conform to the radii of about 1.9 and 1.21 inches, is about 0.35 as shown in test data 64, i.e., a value higher than about 0.22 and about 0.31 disclosed elsewhere herein. Here, the fill density, which is defined as an aggregate mass or weight of the first substance and the second substance per unit area of the first wall of the first elongated flexible container, is no more than about 0.20 ounces per square inch. At 19.41 square-inch fill area, the fill density is no more than about 0.18 ounces per square inch as shown in test data 66.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A thermal modification device for modifying the skin temperature of a user, said thermal modification device comprising:

(a) a first elongated flexible container comprising a first substance disposed therein and a first wall and a second wall, wherein said first substance is a fluid having thermal properties of a first substance; and (b) a second elongated flexible container comprising a second substance disposed therein and a first wall and a second wall, wherein said second substance is a fluid having thermal properties of a second substance, wherein a ratio of the mass of said first substance and the mass of said second substance is at least one of about 0.22 and about 0.31, said first elongated flexible container and said second elongated flexible container are disposed with said second wall of said first elongated flexible container disposed in contacting relationship with said first wall of said second elongated flexible container and said first wall of said first elongated flexible container is configured to be disposed in contacting relationship with the user such that thermal exchanges occur between the skin of the user, said first substance and said second substance to modify the skin temperature of the user.

2. The thermal modification device of claim 1, wherein said second wall of said first elongated flexible container is the same as said first wall of said second elongated flexible container.

3. The thermal modification device of claim 1, wherein said first substance is water.

4. The thermal modification device of claim 1, wherein said second substance is a phase change material (PCM).

5. The thermal modification device of claim 4, wherein said PCM is a material having a melting point that falls in the range of about 49° F. to about 70° F.

6. The thermal modification device of claim 1, wherein each said second wall of said first elongated flexible container and said first wall of said second elongated flexible container comprises a heat transfer surface of about 8.625 inches in length and about 2.25 inches in width.

7. The thermal modification device of claim 1, wherein said second substance is configured to be disposed at a temperature at or higher than about 49 degrees F. prior to the use of said thermal modification device.

8. The thermal modification device of claim 1, wherein said thermal modification device is configured to be flexible such that an arc of at least about 1.21 inches can be formed in said first wall of said first elongated container when said thermal modification device is disposed at about 49° F.

9. The thermal modification device of claim 1, further comprising a length of up to about 14 inches.

10. The thermal modification device of claim 1, further comprising an aggregate weight of said first substance and said second substance per unit area of said first wall of said first elongated flexible container of no more than about 0.20 ounces per square inch.

11. The thermal modification device of claim 1, further comprising an aggregate weight of said first substance and said second substance per unit area of said first wall of said first elongated flexible container of no more than about 0.18 ounces per square inch.

12. The thermal modification device of claim 1, an aggregate weight of said first substance and said second substance is no more than about 2 lbs.

13. A thermal modification device for modifying the skin temperature of a user, said thermal modification device comprising:

(a) a first elongated flexible container comprising a first substance disposed therein and a first wall and a second wall, wherein said first substance is a fluid having thermal properties of a first substance; and (b) a second elongated flexible container comprising a second substance disposed therein and a first wall and a second wall, wherein said second substance is a fluid having thermal properties of a second substance, wherein said first substance is water and said second substance is a material having a melting point that falls in the range of about 49° F. to about 70° F., said first elongated flexible container and said second elongated flexible container are disposed with said second wall of said first elongated flexible container disposed in contacting relationship with said first wall of said second elongated flexible container, said first wall of said first elongated flexible container is configured to be disposed in contacting relationship with the user such that thermal exchanges occur between the skin of the user, said first substance and said second substance to modify the skin temperature of the user and said thermal modification device is configured to be flexible such that an arc of at least about 1.21 inches can be formed in said first wall of said first elongated container when said thermal modification device is disposed at about 49° F.

14. The thermal modification device of claim 13, where a ratio of the mass of said first substance and the mass of said second substance is at least one of about 0.22 and about 0.31.

15. The thermal modification device of claim 13, wherein said second substance is configured to be disposed at a temperature at or higher than about 49 degrees F. prior to the use of said thermal modification device.

16. A thermal modification device for modifying the skin temperature of a user, said thermal modification device comprising:

(a) a first elongated flexible container comprising a first substance disposed therein and a first wall and a second wall, wherein said first substance is a fluid having thermal properties of a first substance; and (b) a second elongated flexible container comprising a second substance disposed therein and a first wall and a second wall, wherein said second substance is a fluid having thermal properties of a second substance, wherein a ratio of the mass of said first substance and the mass of said second substance is at least one of about 0.22 and about 0.31, said first substance is water and said second substance is a material having a melting point that falls in the range of about 49° F. to about 70° F., said first elongated flexible container and said second elongated flexible container are disposed with said second wall of said first elongated flexible container disposed in contacting relationship with said first wall of said second elongated flexible container and said first wall of said first elongated flexible container is configured to be disposed in contacting relationship with the user such that thermal exchanges occur between the skin of the user, said first substance and said second substance to modify the skin temperature of the user.

17. The thermal modification device of claim 16, wherein said second substance is configured to be disposed at a temperature at or higher than about 49 degrees F. prior to the use of said thermal modification device.

18. The thermal modification device of claim 17, wherein said thermal modification device is configured to be flexible such that an arc of at least about 1.21 inches can be formed in said first wall of said first elongated container when said thermal modification device is disposed at about 49° F.

* * * * *